United States Patent [19]

Rehkopf

[11] 4,275,776

[45] Jun. 30, 1981

[54] AUTOMATIC HOLDING DEVICE FOR GASOLINE PUMP HANDLES

[76] Inventor: John W. Rehkopf, 1050 Leith, Maumee, Ohio 43537

[21] Appl. No.: 67,216

[22] Filed: Aug. 17, 1979

[51] Int. Cl.[3] ..... B65B 3/04

[52] U.S. Cl. ..... 141/392; 74/526; 251/90

[58] Field of Search ..... 141/392, 206–229, 141/1; 251/90, 111; 74/526

[56] References Cited

U.S. PATENT DOCUMENTS

| | | | |
|---|---|---|---|
| 4,175,595 | 11/1979 | Noe | 141/392 |
| 4,200,128 | 4/1980 | Pokrzywa | 141/392 |

*Primary Examiner*—Houston S. Bell, Jr.

*Attorney, Agent, or Firm*—George R. Royer

[57] ABSTRACT

A supporting and holding device for maintaining gasoline pump handles in the raised, open position without the necessity of manual assistance. Said holding device comprises a longitudinal, insertable member adapted to be conformably placed, on a temporary basis, between the lower frontal part of the pivotally movable handle member and the upper inside portion of the bottom member of the frame supporting the handle apparatus. Said holding device comprises a longitudinally extending frontal portion on its one end, which frontal portion is configured over its upper surface in an appropriate shape to conformingly lie between the bottom of the handle member and the frame, as stated, in a supportive fashion to keep the handle raised in the open position without requiring the usual manual assistance.

1 Claim, 6 Drawing Figures

AUTOMATIC HOLDING DEVICE FOR GASOLINE PUMP HANDLES

BACKGROUND OF THE INVENTION AND DISCUSSION OF PRIOR ART

The subject invention pertains to a supporting device used to retain, without the use of manual assistance, a pivotally movable gasoline handle in the open position so as to allow gasoline to be automatically drawn through the gasoline pump into the tank of the vehicle being serviced. Such a supporting device obviates the necessity of the operator maintaining his hand on the handle to keep said handle in the upper position, as conventionally arranged for the open position for gasoline flow.

In this regard, in a conventional retail gasoline pumping apparatus, gasoline is drawn upwardly by the pump action by way of a suction elbow from the storage tank. Usually, the attached motor drives a rotary pump which causes the gasoline to be drawn further upwardly through an air separator, and thence to a metering unit and subsequently down through the exit nozzle. Situated in the exit nozzle apparatus is the main valve, which is opened by the lever action of the handle member, which is integrally and pivotally disposed in the framework of the exit nozzle apparatus. When this main valve is opened by the levered handle member, full pressure in the pump mechanism is caused to open the holding valve, also located in the exit nozzle framework. This latter action yields the desired flow of gasoline through the exit nozzle into the desired vehicular tank.

The exit nozzle frame is basically an open rectangular member holding therein a pivotally retractible handle member with a sigmoid configuration. The end of this handle member is pivotally mounted in the lower frontal portion of the frame, and the frontal portion of the handle is adapted on its upward movement to push upwardly a corresponding distance the bottom of a vertical main valve pin. This upward pressure on the main valve pin serves to open the main valve. Thus, in the conventional structure, the handle member must be manually raised or squeezed upwardly so as to cause the frontal end of the handle member to move upwardly a porportional distance and cause thereby a corresponding upward movement on the vertical main valve pin, the latter action of which causes the main valve to open, as stated.

In this described process of pumping gasoline, it is essential that the operator continuously keep his hand on the handle, with necessary upper pressure thereon to maintain it in the upper position, in order that the frontal portion of the handle continuously maintains upward pressure on the bottom of the vertical main valve pin. In full service gasoline stations, for the use of station employees, most gasoline pump handle apparatus have handle locking mechanisms which are integrally disposed on the rear part of the nozzle frame member. These handle locking devices permit the employee-operator to attend to other chores while the gasoline flows through the pump. However, in most self-service gasoline pumping stations, such handle locking devices have generally been eliminated, and as a result self-service customers are required, in most instances, to stay by the pump and continously maintain upward manual pressure on the handle to permit the requisite flow of gasoline, as stated above. Obviously, this latter situation is inefficient for those self-service customers who wish in the interim to attend to other tasks, such as checking oil levels, washing the windshield, or other related and essential automobile maintenance activities. What is required in such a situation is a retaining or holding device to automatically and continuously hold the posterior part of pump handle member in the upper or open position for the time required for the desired gasoline flow. The invention herein is directed towards such an end, and the following objects are directed accordingly.

OBJECTS

In view of the foregoing discussion, the following are objects of the subject invention:

It is an object of the subject invention to provide an improved device for automatically controlling the flow of gas from a gas pump;

Another object of the subject invention is to provide a temporarily insertable device for automatically controlling the flow of gas from a gasoline pump without the requirement of constant manual pressure on the pump handle;

Yet another object of the subject invention is to provide a device for automatically holding open the trigger handle to allow flow of gasoline from a pump without a concomitant need for manually squeezing or gripping the handle during the process;

Still another object of the subject invention is to provide a temporarily insertable device under a portion of a gas pump handle for holding same in the open position without the concomitant assistance of a hand;

A further object of the subject invention is to provide a readily removable and nonpermanent, device for automatically holding the gas pump handle in the upper, open position;

Another object of the subject invention is to provide a device for automatically holding a gasoline pump in the open position;

Other and further objects of the subject invention will become apparent from a reading of the following description taken in conjunction with the drawings.

DESCRIPTION OF GENERAL EMBODIMENT

The subject invention is a retaining and holding device for holding a gasoline pump handle in the referred open position. More specifically, the invention herein encompasses a temporarily insertable device for insertion in the gas pump handle frame just beneath the pivotable handle in order to automatically hold the handle member in the full open position for generating the required flow of gasoline through the pump mechanism. More specifically, the subject holding device is adapted to be inserted under a portion of the bottom surface of the handle member in a wedging manner, so as to hold the bottom of the handle above the upper surface of the bottom frame component, upon which latter upper surface the handle rests while the handle is in the closed position.

The device comprises a longitudinally extending functional member, of generally parallelepiped structural configuration, wherein the one end of said functional member may be tapered and rounded downwardly to a height of relatively smaller portion compared with the remaining body; with the upper surface being conformingly configured to rest compatibly against a portion of the bottom frontal surface of the handle member. The lower surfaces of the holding member is structured with a generally flat even surface so as to rest conformingly against the comparably flat upper surface of the lower frame member.

The subject holding device is inserted at will between the lower surface of the frontal part of the handle member and the upper surface of the lower frame member, as a wedging and support member. In such position it holds the handle member in the upper position so as to keep the main valve open for a continuous flow of gas through the nozzle. Once the desired quantity of gas is pumped the holding device is removed from this wedging position.

DESCRIPTION OF PREFERRED EMBODIMENT

Figure 1:
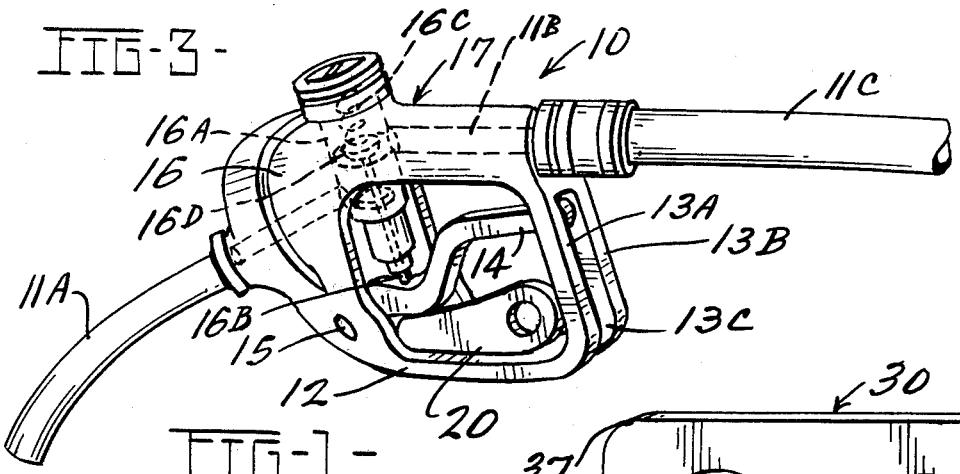
FIG. 1 is a perspective view partially in section of a nozzle frame.
Figure 2:
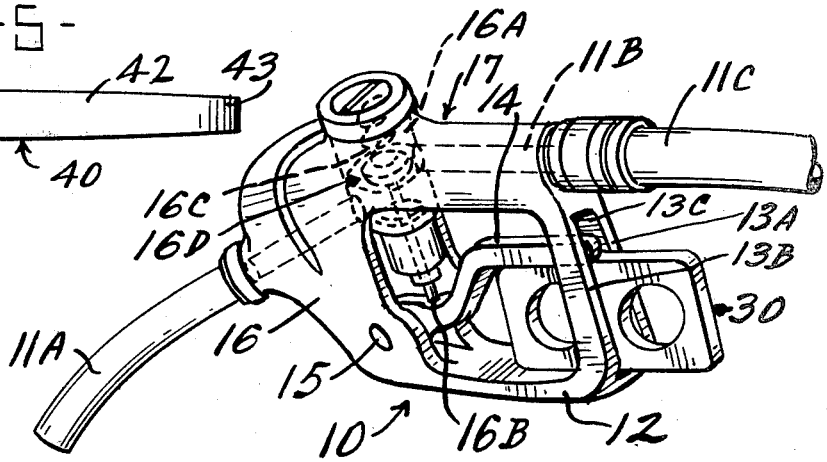
FIG. 2 is a side elevational view, in section of a nozzle frame.

Referring now to the drawings in which a preferred embodiment of the subject invention is shown, and particularly to FIGS. 1 and 2, a exit nozzle frame 10 for a gasoline pump handle is shown as being a generally rectangular member enclosing a pivotable handle member 14 used to actuate the pumping mechanism. The upper part of the handle frame member supports and holds the posterior end of the exit nozzle 11A which leads to an axially oriented chamber 11B integrally structured in the upper interior of the nozzle frame 10. The posterior portion of the interior chamber 11B communicates directly, in turn, with the hose 11C which leads directly to the pump apparatus, now shown. When gasoline is being pumped, it flows as a stream through these three chambers 11A, 11B and 11C continuously.

For further reference purposes in describing the preferred embodiment herein, the word "upper" will be used in reference to that portion of the nozzle frame 10 which cotains the interior chamber 11C, while the word "lower" will refer to that portion of the nozzle frame 10 which lies beneath and opposite to the upper portions thereof. The word "frontal" will refer to that portion of the nozzle frame 10 which lies nearest the nozzle 11A, while the word "posterior" will refer to that portion of the nozzle frame 10 that is situated adjacent the hose member 11C. Moreover, these and other usual references to nozzle frame 10 will be made while the nozzle frame 10 lies the horizontal position with the upper part of the framing being parallel to the horizontal.

More specifically, nozzle frame 10 is a generally open rectangumember, as shown, with posterior parallel vertical support 13A and and 13B. These vertical supports 13A and 13B form therebetween a vertically oriented slit-like opening 13C, as shown in the drawings. The bottom of the frame 10 is comprised a plate member 12, the upper surface of which is basically flat and serves to hold a handle member 14 integrally and pivotally mounted on pivot member 15 affixed on the upper surface of said plate member 12. as represented in the drawings. The frontal part of the frame 10 is a vertically extending member 16, the upper part of which holds the posterior end of the nozzle 11A. Integrally formed in the interior of the frontal member 16 is a vertically extending hollow chamber 16A which houses the upper part of a vertical reciprocating pin 16B, the upper part of which holds a piston that impresses against coil spring 16C in the main valve assembly 16D. Projecting frontally in a T intersection from the vertical chamber 16A is interior chamber 16D which contains the holding valve 16E which runs directly to the chamber of nozzle 11A. As seen the bottom of the vertical pin 16B is engaged against the upper frontal surface of the handle 14, and as this forward part of the handle member moves upwardly it directly impinges upwardly against the lower part of the vertical main valve 16B, causing thereby said main valve assembly to open to commence the flow of gasoline.

The handle pivot member 15 is integrally affixed on the most frontal portion of the upper surface of the lower plate member 12, with the frontal part of the S-shaped handle member being pivotally mounted on said pivot member. As seen from the drawings, the frontal end of the handle member 14 is pivotally mounted so as to be pivotal upward and downward in a plane defined by the inner open area of the frame member 10. More precisely, the respective components of frame 10, as discussed above, form a generally rectangular open area on the inside thereof, said rectangular area being of vertical disposition whenever the handle assembly 10 is situated in the horizontal position. Handle member 14 is pivotally mounted about pivot pin 15 for rotational movement in and through a vertical plane of such rectangular opening with the posterior end of the handle riding upwards and downwards in the vertical opening 13C as shown in the drawings.

As indicated, as the posterior end of the handle 14 is raised progressively by placing one's hand on the posterior area of bottom surface of the handle 14 and pulling upwardly, the frontal upper surface of the handle 14 impinges directly upwardly on the bottom of pin 16B causing it to open the main valve and thereby commence the pumping of gasoline through the apparatus. As can be seen, from the drawings, as the pump handle 14 is manually drawn upwardly, the bottom forward surface of handle 14 separates a minimal distance from the upper surface of the bottom component 12 of the nozzle frame 10 as shown. As long as this distance, as shown, is maintained, by a wedging action, the handle 14 will remain in the upper position and remain open without the need of maintaining upward manual pressure on the handle 14. The subject holding device as described herein below is conceived and structured for this wedging function.

Figure 3:
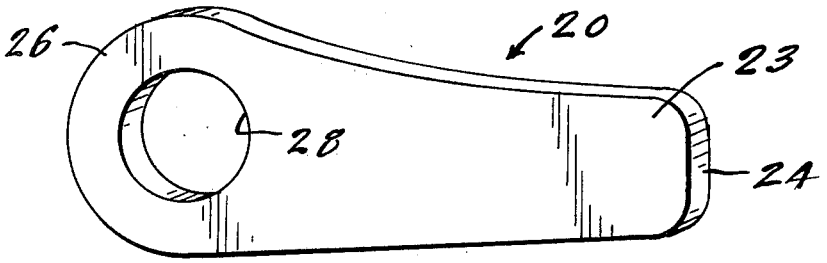
FIG. 3 is a perspective view of one embodiment of the subject invention.

Referring now to FIG. 3 in which one embodiment of the subject invention is shown, a handle holding device 20 is shown, said holding device comprising a longitudinally extending functional member 25 and a gripping member 26. The functional member 25 is disposed on the frontal portion of the holding device while the gripping member 26 is situated on the posterior end of the device 20. The upper edge 23 of the functional member 25 is structured so as to slope downwardly such that height of the functional member 25 narrows as it extends toward its most frontal position, as can be seen in FIG. 3. More specifically, the forward edge 24 of the functional member 25 is preferably of lesser height than the posterior portion of the functional member, and to achieve this proportional relationship, it is desirable to shape the upper edge 23 with a gradually downward slope. Moreover, it is preferable to form a minimal radius on the bottom and upper corners of the frontal edge 24, as represented. The bottom edge of the functional member is preferably flat and when such lower edge is positioned on a correspondingly flat surface, it will lie flush thereagainst. Positioned in the posterior end of the holding device is an optionally disposed rounded gripping device 26, indicated above, said gripping device having a rounded opening 28 therein for placement of a finger or thumb to help facilitate either placement or extrication of the holding device 20 in the appropriate position, as described immediately hereinbelow.

Referring again to FIGS. 1 and 2, in using the holding device 20, the operator grasps the handle 14 and raises it upwardly to the uppermost position representing the full open position. In this uppermost position, as can be seen in FIG. 1, there is a gap created between the lower frontal surface of the handle 14 and the adjacent upper surface of the plate member 12. If this gap is maintained by some wedging action, upward manual pressure on the handle 14 becomes unnecessary. Therefore, the frontal portion of functional member 20 is inserted in this gap between the lower frontal part of the handle 14 and the upper surface of the plate 12. More specifically, the holding device 20 is tightly inserted in a wedging manner in the gap between handle 14 and plate 12. In this wedging position it is preferable that the holding device 20 be maintained upright in the gap in the position shown in FIG. 3, with the upper edge 23 engaging the lower surface of the frontal portion of the handle 14, as shown. As noted, since the lower frontal surface of the handle 14 is curved, the downward sloping upper edge 24 will rest conformingly against said curvature on the handle, thereby enhancing the wedging effect of device 20 upwardly against handle 14. As the holding device is wedged in this indicated position, it will maintain the handle 14 in the uppermost and open position so that the operator can attend to other chores in the meantime. Once the desired quantity of gasoline is pumped into the vehicular tank, the holding device can be removed by grasping the device 20, or its gripping member 26, and manually removing same from the aforesaid gap.

Figure 4:
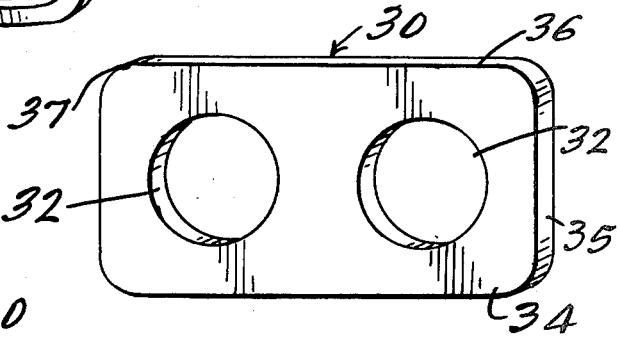
FIG. 4 is a perspective view of a second embodiment of the subject invention.
Figure 5:
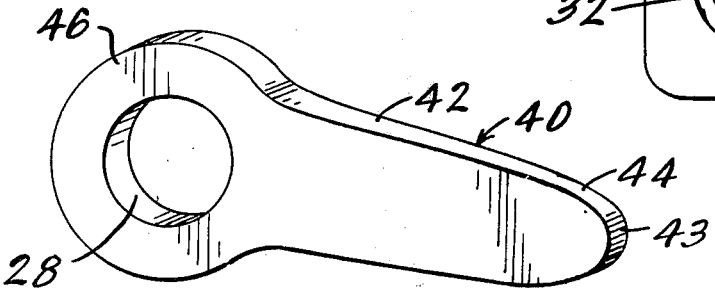
FIG. 5 is a perspective view of a third embodiment of the subject invention.
Figure 6:
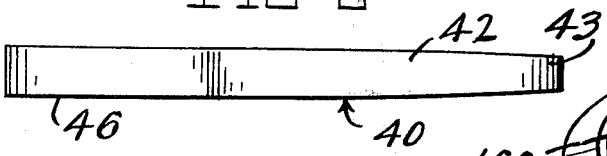
FIG. 6 is a top elevational view of the third embodiment shown in FIG. 5.

Other alternate forms for a holding device are shown in FIGS. 4, 5 and 6. In FIGS. 5 and 6, a holding device 40 is shown which is similar in constructional and operational arrangement to that device shown in FIG. 3. The specific device 40 shown in FIG. 5 has a shorter longitudinally extending functional member 44 than the holding device 20. Moreover, the functional member 44 is tapered on both the upper and lower edges such that the forward edge 43 is rounded into a substantially parabolic shape, as shown. This rounded forward edge 43 enhances the wedging effect of the functional member 44. Moreover, the gripping member 46 with opening 48 serve as optional additions to facilitate the placement and removal process. This holding device is inserted and used in the same manner as holding device 20, as shown in FIG. 2.

Yet another embodiment of the subject invention is shown in FIG. 4. In the embodiment shown in this figure, the holding device 30 is a rectangular member with upper edge 36 and a lower edge 34, both of which are flat, even surfaces. There are one or more rounded openings 32 in the side of the holding device 30, these openings being used as optionally provided gripping devices. The holding device 30 is used in a slightly different fashion than the holding devices described before. Specifically, device 40 is emplaced on the upper surface of plate 12 in the crevice-like opening 13C between vertical posts 13A and 13B, as shown in FIG. 2, with the upper edge 36 being placed just beneath the lower surface of the posterior part of the handle 14. The bottom edge 34 is placed to rest on the upper surface of plate 12, as shown, and in this position the holding device 30 will hold the handle 14 upwardly in the open position, as discussed.

While specific embodiments of the subject invention have been discussed and described, such specific descriptions should not be considered as delimiting the scope of the following claims.

I claim:

1. A gasoline pump handle holding device with a frontal portion and a posterior portion for longitudinal insertion in a gasoline pump handle support frame to hold the gasoline pump handle upwardly in an open position within said support frame, wherein the support frame has a flat surfaced bottom and is adapted for holding therein the gasoline pump handle, the lower surface of which gasoline pump handle is curved such that portions of the lower surface of such gasoline pump handle lie at a variable distance from the flat surface bottom of the support frame forming a lowest and a highest part, said handle holding device comprising:

(a) a longitudinally extending functional member, said longitudinally extending functional member having upper and lower edges, said upper edge and lower edge being sloped downwardly towards the frontal portion thereof, thereby creating a forward portion which is shorter in height than the remaining portions of such holding device, and which forward portion is longitudinally insertible under the lowest part of the lower surface of the gasoline pump handle and above the flat surface bottom of the support frame;

(b) rounded handle means on the posterior portion of such upper and lower edges of said longitudinally extending functional member for manual handling purposes and said rounded portion is disposed on the posterior portion creating a rearward portion which is integral with and higher in height than the other portions of such holding device for mating engagement at the highest part between the flat bottom surface of the support frame and the posterier portion of the lower surface of the pump handle.

* * * * *